US006932679B2

(12) United States Patent
Talieh et al.

(10) Patent No.: US 6,932,679 B2
(45) **Date of Patent: *Aug. 23, 2005**

(54) APPARATUS AND METHOD FOR LOADING A WAFER IN POLISHING SYSTEM

(75) Inventors: Homayoun Talieh, San Jose, CA (US); Konstantin Volodarsky, San Francisco, CA (US); Jalal Ashjaee, Cupertino, CA (US); Douglas W. Young, Sunnyvale, CA (US)

(73) Assignee: ASM Nutool, Inc., Fremont, CA (US)

( * ) Notice: Subject to any disclaimer, the term of this patent is extended or adjusted under 35 U.S.C. 154(b) by 0 days.

This patent is subject to a terminal disclaimer.

(21) Appl. No.: 10/295,197

(22) Filed: Nov. 15, 2002

(65) Prior Publication Data

US 2003/0096561 A1 May 22, 2003

Related U.S. Application Data

(63) Continuation of application No. 10/252,149, filed on Sep. 20, 2002, now Pat. No. 6,604,988, which is a continuation of application No. 09/880,730, filed on Jun. 12, 2001, now Pat. No. 6,464,571, which is a continuation-in-part of application No. 09/684,059, filed on Oct. 6, 2000, now Pat. No. 6,468,139, which is a continuation-in-part of application No. 09/576,064, filed on May 22, 2000, now Pat. No. 6,207,572, which is a continuation of application No. 09/201,928, filed on Dec. 1, 1998, now Pat. No. 6,103,628.

(51) Int. Cl.[7] ..... B24B 1/00

(52) U.S. Cl. ..... 451/59; 451/11; 451/285

(58) Field of Search ..... 451/28, 41, 59, 451/11, 12, 259, 285, 287–289, 307, 319, 324, 364, 365, 385, 397, 398, 402, 487; 156/345.14

(56) References Cited

U.S. PATENT DOCUMENTS

| | | | | | |
|---|---|---|---|---|---|
| 669,923 | A | | 3/1901 | Grauert | |
| 3,559,346 | A | * | 2/1971 | Paola | 451/41 |
| 3,888,050 | A | | 6/1975 | Elm | |
| 4,802,309 | A | | 2/1989 | Heynacher | |
| 4,944,119 | A | * | 7/1990 | Gill, Jr. et al. | 451/331 |
| 5,095,661 | A | * | 3/1992 | Gill, Jr. et al. | 451/111 |
| 5,162,047 | A | * | 11/1992 | Wada et al. | 29/25.01 |
| 5,245,796 | A | | 9/1993 | Miller et al. | |
| 5,329,732 | A | * | 7/1994 | Karlsrud et al. | 451/289 |
| 5,335,453 | A | | 8/1994 | Baldy et al. | |

(Continued)

FOREIGN PATENT DOCUMENTS

| | | |
|---|---|---|
| DE | 31 13 204 | 10/1982 |
| EP | 0 517 594 | 12/1992 |
| WO | WO 97/20660 | 6/1997 |
| WO | WO 99/22908 | 5/1999 |
| WO | WO 02/02272 | 1/2002 |

OTHER PUBLICATIONS

Steigerwald et al., "Pattern geometry effects in the chemical–mechanical polishing of inlaid copper structures," Oct. 1994, pp. 2482–2848.

*Primary Examiner*—David B. Thomas
(74) *Attorney, Agent, or Firm*—Knobbe Martens Olson & Bear LLP

(57) ABSTRACT

The present invention includes a polishing pad or belt secured to a mechanism that allows the pad or belt to move in a reciprocating manner, i.e. in both forward and reverse directions, at high speeds. The constant bidirectional movement of the polishing pad or belt as it polishes the wafer provides superior planarity and uniformity across the wafer surface. When a fresh portion of the pad is required, the pad is moved through a drive system containing rollers, such that the rollers only touch a back side of the pad, thereby minimizing sources of friction other than the wafer that is being polished from the polishing side of the pad, and maximizing the lifetime of the polishing pad.

24 Claims, 10 Drawing Sheets

U.S. PATENT DOCUMENTS 5,377,452 A 1/1995 Yamaguchi
5,377,453 A 1/1995 Pemeczky
5,429,733 A 7/1995 Ishida
5,473,433 A * 12/1995 Miller ..... 356/514
5,476,414 A * 12/1995 Hirose et al. ..... 451/288
5,489,235 A 2/1996 Gagliardi
5,498,199 A * 3/1996 Karlsrud et al. ..... 451/289
5,518,542 A * 5/1996 Matsukawa et al. ..... 118/52
5,558,568 A 9/1996 Talieh et al.
5,565,034 A * 10/1996 Nanbu et al. ..... 118/668
5,593,344 A 1/1997 Weldon et al.
5,650,039 A 7/1997 Talieh
6,679,212 B2 10/1997 Kato et al.
5,686,143 A * 11/1997 Matsukawa et al. ..... 427/271
5,692,947 A 12/1997 Talieh et al.
5,707,409 A 1/1998 Martin
5,759,918 A 6/1998 Hoshizaki et al.
5,762,751 A 6/1998 Bleck et al.
5,770,521 A 6/1998 Pollock
5,795,215 A * 8/1998 Guthrie et al. ..... 451/286
5,807,165 A 9/1998 Uzoh et al.
5,810,964 A 9/1998 Shiraishi
5,851,136 A 12/1998 Lee
5,893,755 A 4/1999 Nakayoshi
5,899,798 A 5/1999 Trojan et al.
5,899,801 A 5/1999 Tolles et al.
5,908,530 A 6/1999 Hoshizaki et al.
5,913,716 A 6/1999 Mucci et al.
5,951,377 A 9/1999 Vaughn et al.
5,961,372 A 10/1999 Shendon
5,975,988 A 11/1999 Christianson
5,993,302 A * 11/1999 Chen et al. ..... 451/285
6,009,890 A * 1/2000 Kaneko et al. ..... 134/133
6,017,831 A 1/2000 Beardsley
6,024,630 A * 2/2000 Shendon et al. ..... 451/41
6,045,716 A * 4/2000 Walsh et al. ..... 216/88
6,068,542 A 5/2000 Hosokai
6,086,454 A * 7/2000 Watanabe et al. ..... 451/36
6,103,628 A * 8/2000 Talieh ..... 451/63
6,110,025 A 8/2000 Williams et al.
6,113,479 A 9/2000 Sinclair et al.
6,129,540 A 10/2000 Hoopman et al.
6,135,859 A 10/2000 Tietz
6,136,715 A 10/2000 Shendon et al.
6,179,690 B1 1/2001 Talieh
6,180,020 B1 * 1/2001 Moriyama et al. ..... 216/88
6,207,572 B1 * 3/2001 Talieh ..... 438/692
6,241,583 B1 6/2001 White
6,267,642 B1 * 7/2001 Vogtmann et al. ..... 451/8
6,302,767 B1 10/2001 Tietz
6,312,319 B1 11/2001 Donohue et al.
6,354,926 B1 * 3/2002 Walsh ..... 451/285
6,379,231 B1 4/2002 Birang et al.
6,405,740 B1 * 6/2002 Vogtmann et al. ..... 134/153
6,413,873 B1 7/2002 Li et al.
6,419,559 B1 7/2002 Gurusamy et al.
6,428,394 B1 8/2002 Mooring et al.
6,439,978 B1 8/2002 Jones et al.
6,443,824 B2 * 9/2002 Shendon et al. ..... 451/288
6,468,139 B1 * 10/2002 Talieh et al. ..... 451/296
6,475,070 B1 11/2002 White
6,500,056 B1 12/2002 Krusell et al.
2002/0111121 A1 8/2002 Sun et al.
2002/0123298 A1 9/2002 Krusell et al.

* cited by examiner

APPARATUS AND METHOD FOR LOADING A WAFER IN POLISHING SYSTEM

CROSS-REFERENCES TO RELATED APPLICATIONS

This application is a continuation of Ser. No. 10/252,149 filed Sep. 20, 2002 now U.S. Pat. No. 6,604,988, which is a continuation of Ser. No. 09/880,730, filed Jun. 12, 2001 now U.S. Pat. No. 6,464,571, which is a continuation in part of Ser. No. 09/684,059, filed Oct. 6, 2000 now U.S. Pat. No. 6,468,139, which is a continuation in part of Ser. No. 09/576,064, filed May 22, 2000, now U.S. Pat. No. 6,207,572 issued Feb. 27, 2001, which is a continuation of Ser. No. 09/201,928, filed Dec. 1, 1998, now U.S. Pat. No. 6,103,628 issued Aug. 15, 2000, all incorporated herein by reference. Previously disclosed subject matter from U.S. Pat. No. 6,103,628 is included herein.

FIELD OF THE INVENTION

The present invention relates to the field of chemical mechanical polishing. More particularly, the present invention relates to methods and apparatus for polishing a semiconductor wafer to a high degree of planarity and uniformity. This is achieved when the semiconductor wafer is polished with pads at high bi-directional linear or reciprocating speeds. The present invention is further directed to a wafer housing for loading and unloading wafers.

BACKGROUND OF THE INVENTION

Chemical mechanical polishing (CMP) of materials for VLSI and ULSI applications has important and broad application in the semiconductor industry. CMP is a semiconductor wafer flattening and polishing process that combines chemical removal of layers such as insulators, metals, and photoresists with mechanical polishing or buffering of a wafer layer surface. CMP is generally used to flatten surfaces during the wafer fabrication process, and is a process that provides global planarization of the wafer surface. For example, during the wafer fabrication process, CMP is often used to flatten/polish the profiles that build up in multilevel metal interconnection schemes. Achieving the desired flatness of the wafer surface must take place without contaminating the desired surface. Also, the CMP process must avoid polishing away portions of the functioning circuit parts.

Conventional systems for the chemical mechanical polishing of semiconductor wafers will now be described. One conventional CMP process requires positioning a wafer on a holder rotating about a first axis and lowered onto a polishing pad rotating in the opposite direction about a second axis. The wafer holder presses the wafer against the polishing pad during the planarization process. A polishing agent or slurry is typically applied to the polishing pad to polish the wafer. In another conventional CMP process, a wafer holder positions and presses a wafer against a belt-shaped polishing pad while the pad is moved continuously in the same linear direction relative to the wafer. The so-called belt-shaped polishing pad is movable in one continuous path during this polishing process. These conventional polishing processes may further include a conditioning station positioned in the path of the polishing pad for conditioning the pad during polishing. Factors that need to be controlled to achieve the desired flatness and planarity include polishing time, pressure between the wafer and pad, speed of rotation, slurry particle size, slurry feed rate, the chemistry of the slurry, and pad material.

Although the CMP processes described above are widely used and accepted in the semiconductor industry, problems remain. For instance, there remains a problem of predicting and controlling the rate and uniformity at which the process will remove materials from the substrate. As a result, CMP is a labor intensive and expensive process because the thickness and uniformity of the layers on the substrate surface must be constantly monitored to prevent overpolishing or inconsistent polishing of the wafer surface.

Accordingly, an inexpensive and more consistent method and apparatus for polishing a semiconductor wafer are needed.

SUMMARY OF THE INVENTION

It is an object of the present invention to provide methods and apparatus that polish a semiconductor wafer with uniform planarity.

It is another object of the present invention to provide methods and apparatus that polish a semiconductor wafer with a pad having high bi-directional linear or reciprocating speeds.

It is still another object of the present invention to provide a polishing method and system that provides a "fresh" polishing pad to the wafer polishing area, thereby improving polishing efficiency and yield.

It is still a further object of the present invention to provide a drive system for providing the fresh polishing pad from a roll of a polishing pad such that the lifetime of the polishing pad is maximized.

These and other objects of the present invention, among others, either singly or in combination, are obtained by providing methods and apparatus that polish a wafer with a pad having high bi-directional linear speeds. The present invention includes a polishing pad or belt secured to a mechanism that allows the pad or belt to move in a reciprocating manner, i.e. in both forward and reverse directions, at high speeds. The constant bidirectional movement of the polishing pad or belt as it polishes the wafer provides superior planarity and uniformity across the wafer surface. When a fresh portion of the pad is required, the pad is moved through a drive system containing rollers, such that the rollers only touch a back portion of the pad, thereby eliminating sources of friction other than the wafer that is being polished, and maximizing the lifetime of the polishing pad.

BRIEF DESCRIPTION OF THE DRAWINGS

These and other objects and advantages of the present invention will become apparent and more readily appreciated from the following detailed description of the presently preferred exemplary embodiment of the invention taken in conjunction with the accompanying drawings, of which.

DETAILED DESCRIPTION OF THE PREFERRED EMBODIMENTS

Figure 1:
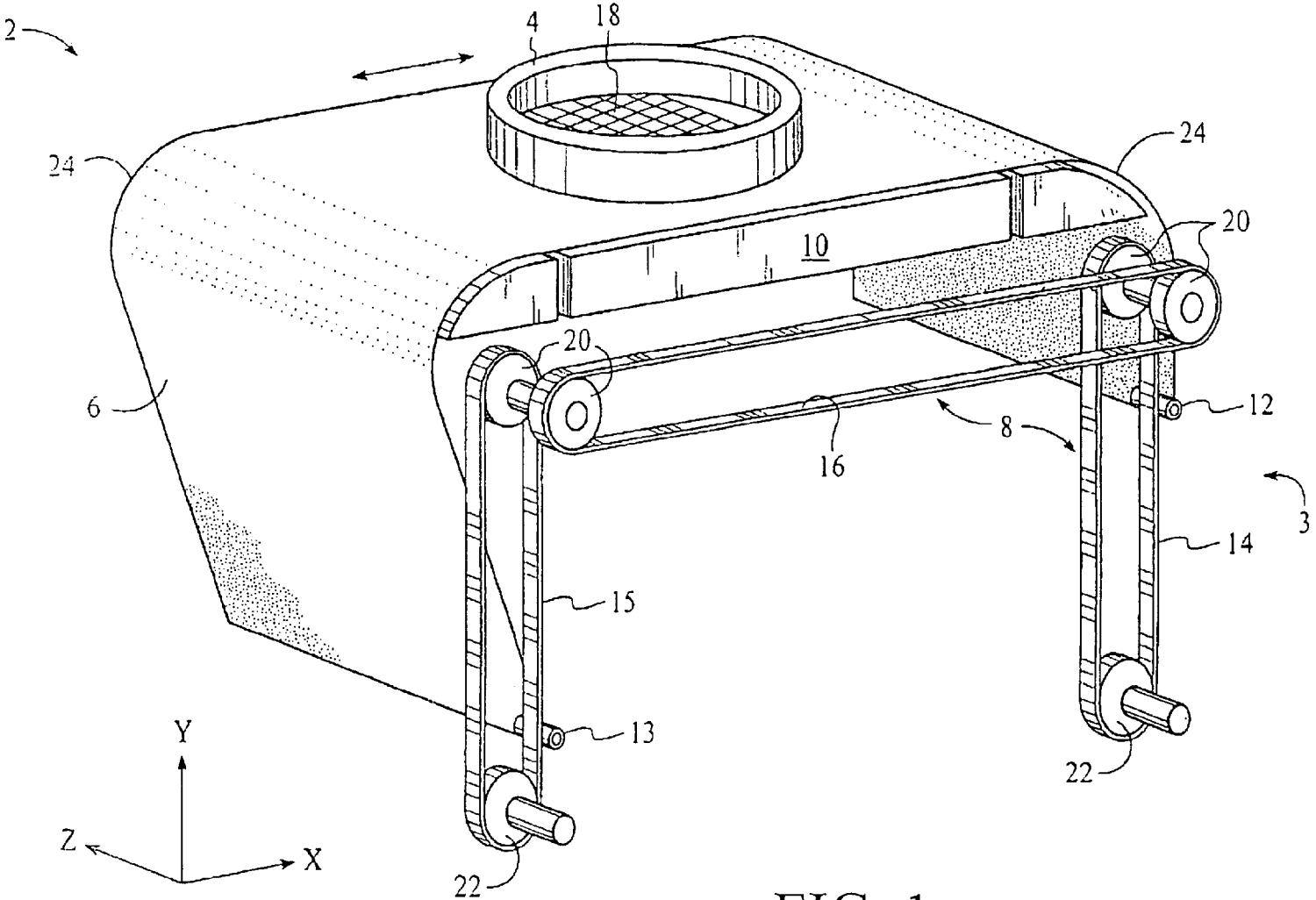
FIG. 1 illustrates a perspective view of a polishing method and apparatus in accordance with the first preferred embodiment of the present invention.

The preferred embodiments of the present invention will now be described with reference to FIGS. 1–8, wherein like components are designated by like reference numerals throughout the various figures. The present invention is directed to CMP methods and apparatus that can operate at high bi-directional linear pad or reciprocating speeds and a reduced foot-print. The high bi-directional linear pad speeds optimize planarity efficiency while the reduced foot-print reduces the cost of the polishing station. Further, because the polishing pad is adapted to travel in bi-directional linear directions, this reduces the pad glazing effect, which is a common problem in conventional CMP polishers. Because the pad travels in bi-directional linear directions, the pad (or pad attached to a carrier) is substantially self-conditioning.

Figure 2:
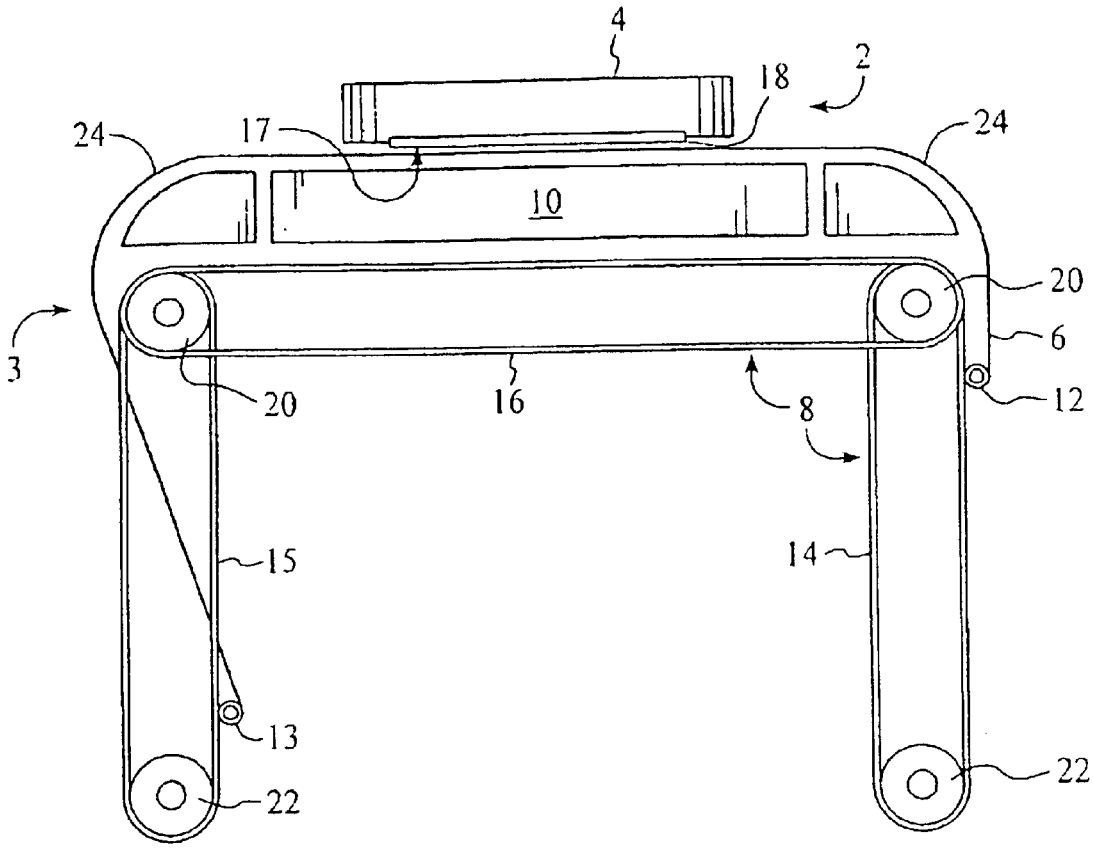
FIG. 2 illustrates a side view of a polishing method and apparatus in accordance with the first preferred embodiment of the present invention.

FIG. 1 illustrates a perspective view and FIG. 2 illustrates a side view of an apparatus of a first preferred embodiment of the present invention. The wafer polishing station 2 includes a bi-directional linear, or reverse linear, polisher 3 and a wafer housing 4. The wafer housing 4, which can rotate about its center axis and/or move side to side or vertically, securely positions a wafer 18 or workpiece so that a surface 17 may be polished. In accordance with the present invention, novel methods and apparatus of loading and unloading the wafer 18 onto the wafer housing 4 is described more fully later herein.

The reverse linear polisher 3 includes a polishing pad 6 for polishing the wafer surface 17, a mechanism 8 for driving the polishing pad 6 in a bi-directional linear or reciprocating (forward and reverse) motion, and a support plate 10 for supporting the pad 6 as the pad 6 polishes the wafer surface 17. A polishing agent or slurry containing a chemical that oxidizes and mechanically removes a wafer layer is flowed between the wafer 18 and the polishing pad 6. The polishing agent or slurry such as colloidal silica or fumed silica is generally used. The polishing agent or slurry generally grows a thin layer of silicon dioxide or oxide on the wafer surface 17, and the buffering action of the polishing pad 6 mechanically removes the oxide. As a result, high profiles on the wafer surface 17 are removed until an extremely flat surface is achieved. It should also be noted that the size of the particles from the polishing agent or slurry used to polish the wafer surface 17 is preferably at least two or three times larger than the feature size of the wafer surface 17. For example, if the feature size of the wafer surface 17 is 1 micron, then the size of the particles should be at least 2 or 3 microns.

The underside of the polishing pad 6 is attached to a flexible but firm and flat material (not shown) for supporting the pad 6. The polishing pad 6 is generally a stiff polyurethane material, although other suitable materials may be used that is capable of polishing wafer surface 17. In addition, the polishing pad 6 may be non-abrasive or abrasive, depending on the desired polishing effect and chemical solution used.

In accordance with the first preferred embodiment of the present invention, the driving or transmission mechanism 8 for driving the polishing pad 6 in a bi-directional linear motion will now be described. Although FIGS. 1–2 illustrate only one driving mechanism 8 from the front side of the reverse linear polisher 3, it is understood that on the backside of the reverse linear polisher 3, a similar driving mechanism 8 is also present. Driving mechanism 8 includes three timing belts, two vertically suspending timing belts 14, 15 and one horizontally suspending timing belt 16. The timing belts 14, 15, and 16 may be formed of any suitable material such as stainless steel or high strength polymers having sufficient strength to withstand the load applied to the belts by the wafer 18. One end of the vertically suspending timing belts 14, 15 is secured to rollers 20 while the other end is secured to rollers 22. Likewise, each end of the horizontally suspending timing belt 16 is secured to rollers 20. As illustrated in FIG. 1, it is noted that the horizontally suspending timing belt 16 is placed in a z-plane slightly outside the z-plane of the vertically suspending timing belts 14, 15.

Rollers 20 link the two vertically suspending timing belts 14, 15 with the horizontally suspending timing belt 16 so that each belts rate of rotation depends on the rate of rotation of the other belts. The rollers 20 and 22 retain the timing belts 14, 15, and 16 under proper tension so that the polishing pad 6 is sufficiently rigid to uniformly polish the wafer surface 17. The tension of the timing belts may be increased or decreased as needed by adjusting the position of rollers 22 relative to roller 20.

Although one embodiment of the present invention describes a driving mechanism having three timing belts secured on four rollers, it is understood that any suitable number of rollers and/or timing belts, or a driving mechanism that does not rely on rollers/belts, i.e. a seesaw mechanism, such that it provides the bi-directional linear or reciprocating motion, are intended to be within the scope and spirit of the present invention.

An important aspect of one embodiment of the present invention is that the polishing pad 6 and the corresponding support material is adapted to bend at an angle at corners 24, which angle is preferably about 90°. Each end of the polishing pad 6 is attached to a point on the two vertically positioned timing belts 14, 15 by attachments 12, 13. One end of the polishing pad 6 is secured to attachment 12, and the other end is secured to attachment 13. Attachments 12 and 13 are preferably a sleeve and rod, as more fully described later herein. Referring again to FIGS. 1 and 2, as one end of the polishing pad 6 travels vertically downward with the assistance of timing belt 14 and attachment 12, the other end of the polishing pad 6 travels vertically upward with the assistance of timing belt 15 and attachment 13. The mechanical alignment of the timing belts 14, 15, and 16 with the rollers 20 and 22 allows such movement to occur.

In order to drive the timing belts 14, 15, and 16 to a desired speed, a conventional motor (not shown) is used to rotate rollers 20 and/or 22. The motor is connected to rollers 20 or 22 or to any suitable element connected to rollers 20 and/or 22, and it provides the necessary torque to rotate rollers 20 and 22 to a desired rate of rotation. The motor directly/indirectly causes rollers 20 and 22 to rotate so that the timing belts 14, 15, and 16 are driven at a desired speed in both forward and reverse directions. For instance, when attachment 13 reaches roller 22 during its downward motion, it will reverse the direction of the polishing pad 6 as attachment 13 now travels upward. Soon thereafter, the same attachment 13 now reaches roller 20 and again changes direction in a downward direction. The reciprocating movement of attachment 13 allows the polishing pad 6 to move in both forward and reverse directions. Preferably, the speed at which the polishing pad 6 is moved is within the range of approximately 100 to 600 feet per minute for optimum planarization of the wafer surface 17. However, it should be understood that the speed of the polishing pad 6 may vary depending on many factors (size of wafer, type of pad, chemical composition of slurry, etc.). Further, the pad 6 may be moved in both bi-directional linear directions at a predetermined speed, which preferably averages between 100 to 600 feet per minute.

Figure 4:
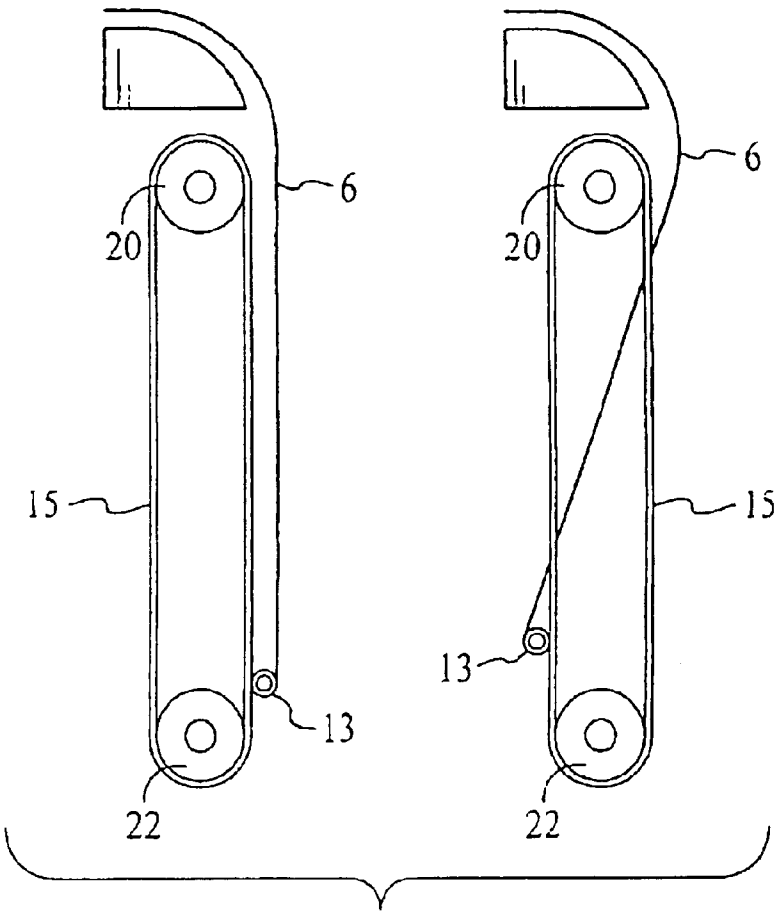
FIG. 4 illustrates side views of a polishing pad moving around the timing belt rollers in accordance with the first preferred embodiment of the present invention.
Figure 3:
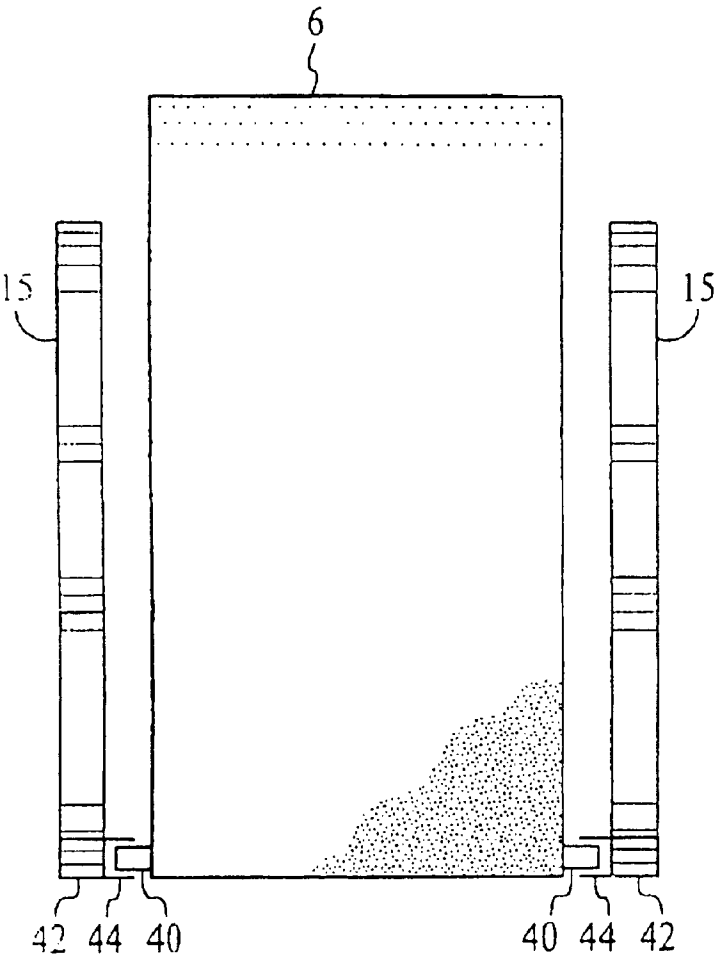
FIG. 3 illustrates a front view of a method and apparatus for attaching a polishing pad to timing belts in accordance with the first preferred embodiment of the present invention.

FIG. 3 illustrates a front view and FIG. 4 illustrates a side view of a method and apparatus for attaching the polishing pad 6 to the timing belts 14, 15 in accordance with the first preferred embodiment of the present invention. As described earlier herein, the underside of the polishing pad 6 is attached to the flexible but firm and flat material, which is non-stretchable. At each end of the material, and thus the ends of the polishing pad 6, a rod 40 is attached. The rod 40 extends horizontally from the pad 6 as shown in FIG. 3. A sleeve 42, i.e. a cylinder or a slit, is also attached to each of the vertically suspending timing belts 14, 15, and a portion 44 of the sleeve 42 extends horizontally to join the rod 40, as again illustrated in FIG. 3. When the rod 40 and the sleeve 42 are joined, this allows the polishing pad 6 to travel bi-directional with high linear speeds without the problem of having the polishing pad 6 being wrapped around the rollers 20, 22. FIG. 4 further illustrates a side view of the polishing pad 6 as it rotates around the rollers 20, 22.

As described earlier, the polishing pad 6 bends at an angle, preferably about 90° at the two corners 24, in accordance with one embodiment of the invention. This approach is beneficial in this embodiment for various reasons. Since the length of the polishing pad 6 on the horizontal plane needed to polish the wafer surface 17 needs to be only slightly longer than the wafer 18 diameter, the entire length of polishing pad should be only slightly longer than three times the wafer 18 diameter, in accordance with this embodiment. This allows the most efficient and economical use of the entire polishing pad 6. During polishing, slurry or other agent may be applied to the portions of the polishing pad 6 that are not in contact with the wafer surface 17. The slurry or other agent can be applied to the polishing pad preferably at locations near corners 24. The configuration of the polishing pad 6 described above also decreases the size of a support plate 10 needed to support the pad 6. Furthermore, though the bi-directional linear movement provides for a substantially self conditioning pad, a conditioning member can also be disposed on or about this same location.

The novel approach described above has many other advantages and benefits. For example, the CMP device of the present invention takes up less space than most traditional CMP devices because about two-thirds of the polishing pad 6 can be in a vertical position. The bi-directional linear movement of the CMP device further increases the pad usage efficiency because the reciprocating movement of the pad 6 provides a self-conditioning function, since the pad 6 is moving in different, preferably opposite, directions.

In accordance with the present invention, only one wafer is generally polished during a single time. As described above, the polishing pad 6 moves bi-directional with high linear speeds so as to uniformly polish the wafer surface 17. Because high pad speeds are needed to polish the wafer surface 17, the momentum, and thus inertia created is very high. Thus, as the polishing pad 6 reverses direction, sufficient energy is needed to keep the pad moving at desired speeds. If the total area (length and width) of the polishing pad 6 is minimized, the energy needed to keep the pad moving at desired speeds is decreased accordingly. Thus, by limiting the length of the polishing area of the polishing pad 6, a conventional motor can handle the necessary energy needed to keep the pad moving at desired speeds in both forward and reverse directions. The entire length of the active polishing area of the polishing pad 6 should preferably be slightly longer than two-diameter lengths of the wafer 18, and preferably three-diameter lengths of the wafer 18. The reason for this is so that the polishing pad 6 may be conditioned and slurry may be applied to both sides of the pad opposite where the wafer 18 is positioned, in close proximity to corners 24. Also, although it is preferred that the polishing pad 6 width is wider than the wafer diameter, in other embodiments, the width of the polishing pad 6 may be smaller than the wafer diameter.

Although the present invention is adapted to polish a single wafer at one time, one skilled in the art may modify the preferred embodiment of the invention in order to polish multiple wafers at one time. Slurry (not shown) can be applied to the surface of the polishing pad 6 in conventional manners and the pad 6 can further be conditioned in conventional manners.

Referring again to FIGS. 1–2, the support plate 10 for supporting the polishing pad 6 will now be described. The polishing pad 6 is held against the wafer surface 17 with the support of the support plate 10, which may be coated with a magnetic film. The backside of the support material to which the polishing pad 6 is attached may also be coated with a magnetic film, thus causing the polishing pad 6 to levitate off the support plate 10 while it moves at a desired speed. It should be understood that other conventional methods can be used to levitate the polishing pad 6 off the support plate 10 while it polishes the wafer surface 17, such as air, magnetic, lubricant, and/or other suitable liquids.

Figure 5:
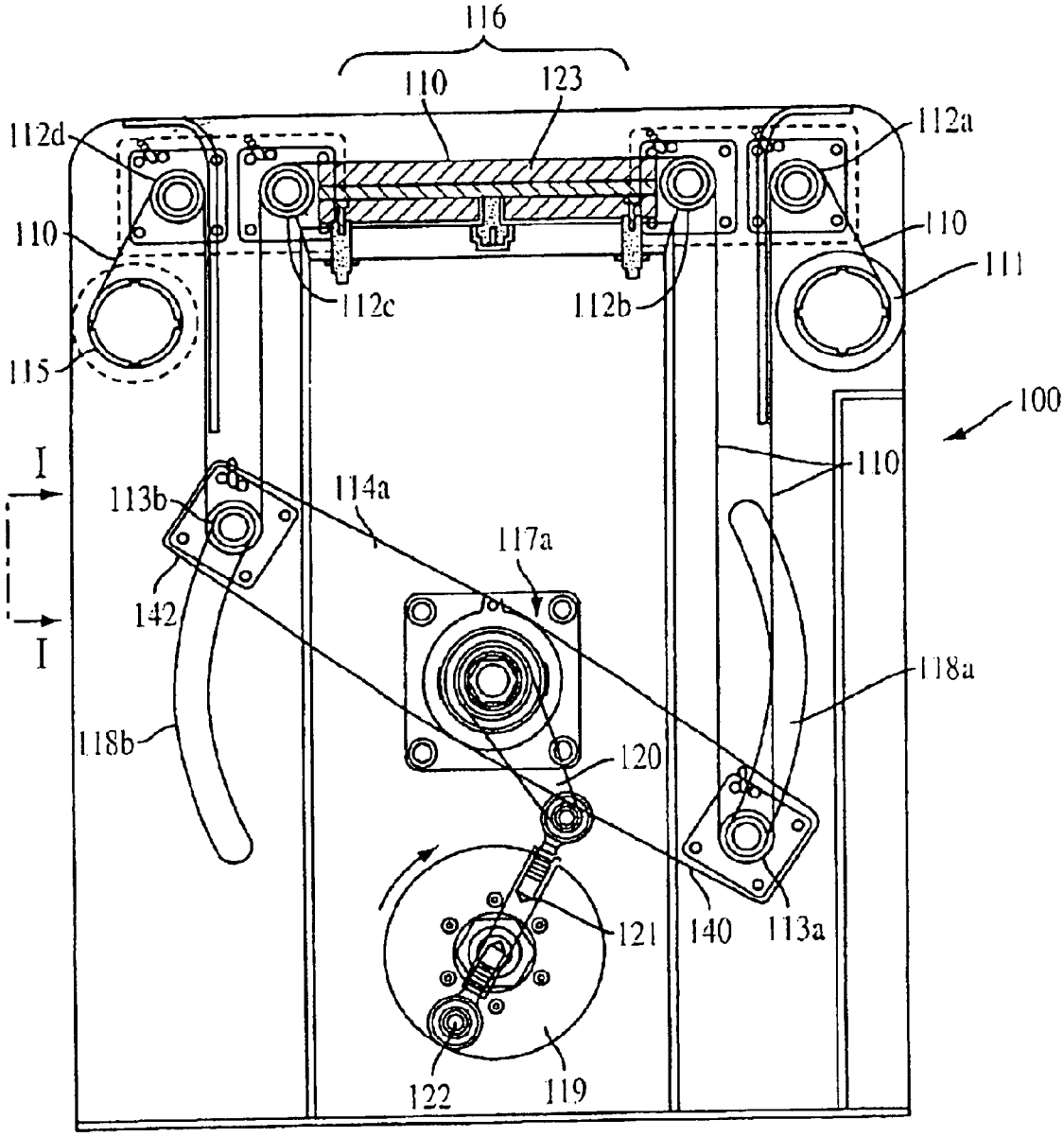
FIG. 5 illustrates a side view of a polishing apparatus and driving mechanism in accordance with the second preferred embodiment of the present invention.
Figure 6:
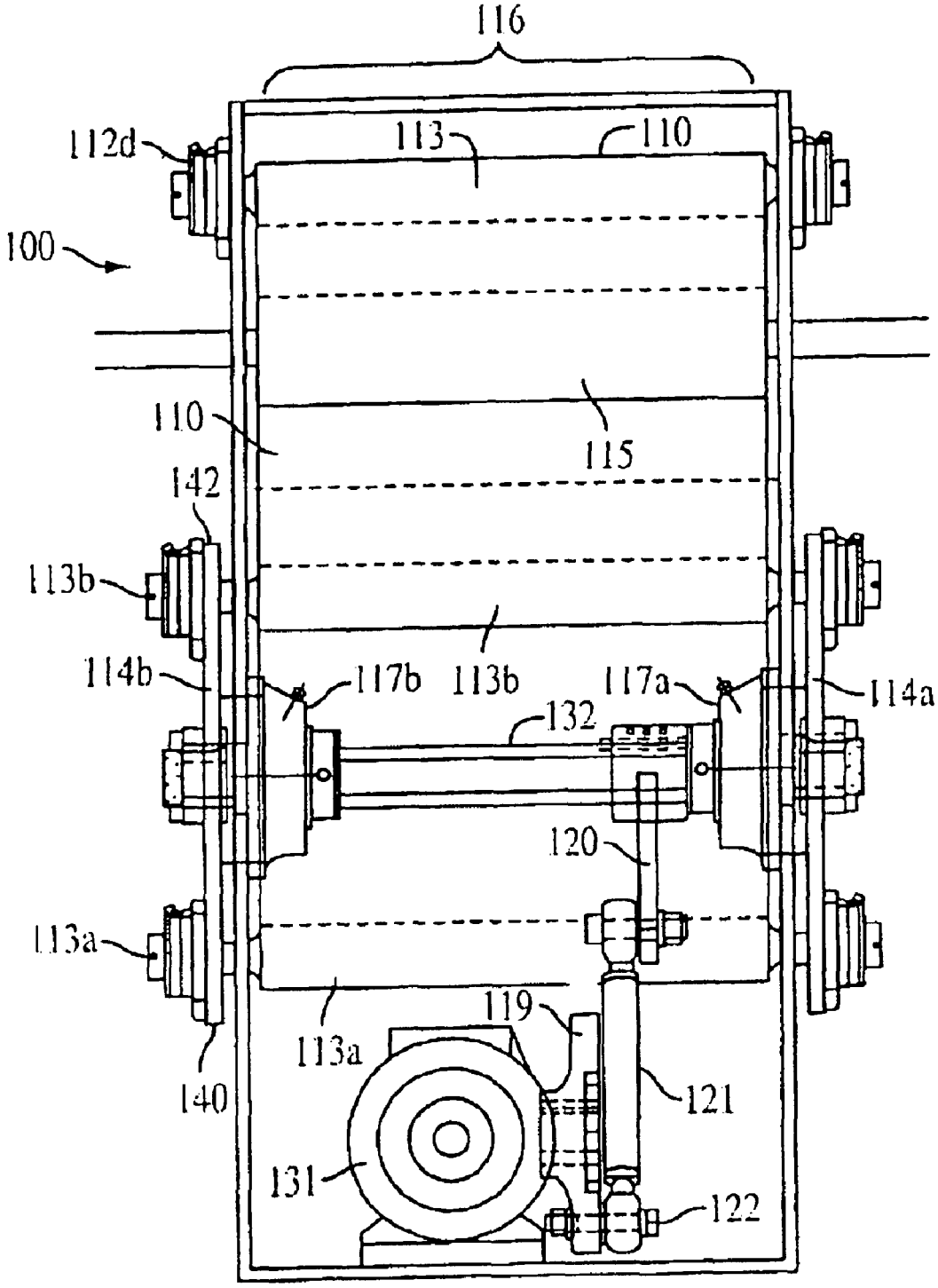
FIG. 6 illustrates a cross sectional view of the polishing apparatus and driving mechanism of FIG. 5 in accordance with the second preferred embodiment of the present invention.

FIGS. 5 and 6 illustrate side and cross sectional views (along line I—I), respectively, of a polishing apparatus and driving mechanism in accordance with the second preferred embodiment of the present invention. Reference will be made concurrently to FIGS. 5 and 6 for a more complete understanding of the second preferred embodiment of the present invention.

The polishing apparatus 100 includes a driving mechanism having a bi-directional linear, or reverse linear, polishing belt 110 for polishing a wafer (not shown) that is supported by the wafer housing 4 (not shown), which is described in greater detail later herein. A processing area 116 of the apparatus 100 includes a section of the polishing belt 110 that is supported by a platen 123, which platen 123 is capable of providing "gimbaling" action for leveling/suspending the section of the polishing belt 110 above it. In addition, an air or magnetic bearing may be positioned underneath the section of the polishing belt 110 in the processing area 116 to control the pressure between the polishing belt 110 and the wafer surface during the polishing process.

Besides the processing area 116, the polishing apparatus 100 includes in its top portion a supply'spool 111, a receiving spool 115, and idle rollers 112*a,* 112*b,* 112*c,* 112*d.* In addition, the apparatus 100 includes a pair of rocker arms 114*a,* 114*b,* each having rocker bearings 117*a,* 117*b,* respectively, connected thereto via a shaft 132. Further connected to each end of the rocker arms 114*a,* 114*b* are a pair of rocker arm rollers 113*a,* 113*b,* which are capable of moving about within the railings 118*a,* 118*b,* respectively. The shaft 132 connecting the pair of rocker arms 114*a,* 114*b* is further connected to a drive crank 119 through an elbow 120 and a connecting rod 121. As shown, the connecting rod 121 can be fixed to the drive crank 119 at position 122. Additionally, a first motor 131 is connected to the drive crank 119 for rotating the same, which operation is described in greater detail below.

During operation in accordance with the second preferred embodiment, the polishing belt 110 originates from the supply spool 111 to a first idle roller 112*a.* Although not expressly illustrated, a conventional clutch mechanism is connected to the supply spool 111, which is used to adjust the tension of the polishing belt 110 between the supply spool 111 and the receiving spool 115. The polishing belt 110 is then routed around the first idle roller 112*a* and a first rocker arm roller 113*a* to a second idle roller 112*b.* The polishing belt 110 is again routed around the second idle roller 112*b* to a third idle roller 112*c.* Thereafter, the polishing belt 110 is routed around a second rocker arm roller 113*b* and a fourth idle roller 112*d* to the receiving spool 115.

A second conventional motor (not shown) is connected to the receiving spool 115 for rotating the same so that sections of the polishing belt 110 can be pulled from the supply spool 111 to the receiving spool 115. For example, when the second motor is activated and the clutch resistance is properly adjusted, the second motor rotates the receiving spool 111 in a manner such that sections of the polishing belt 110 are received therein. In a similar manner, the tension of the polishing belt 110 between the supply spool 111 and receiving spool 115 can be adjusted by providing the appropriate motor torque and clutch resistance. This technique can be used to provide the proper contact pressure between the polishing belt 110 and the wafer surface in the processing area 116.

When a section of the polishing belt 110 is positioned in the processing area 116, the first motor 131 can be activated to rotate the drive crank 119 in a circular manner. This in turn allows the connecting rod 121 to push the elbow 20 upwards, thereby moving the right section 140 of the rocker arm 114 upwards. This allows the first rocker arm roller 113*a* to move upwards (from the position as illustrated in FIG. 5) along the right railing 118*a.* Simultaneously, this causes the second rocker arm roller 113*b* on the left section 142 of the rocker arm 114 to move downwards along the left railing 118*b.* Thus, as the drive crank 119 is continuously rotated, the first and second rocker arm rollers 113*a,* 113*b* continue to move up and down along right and left railings 118*a,* 118*b,* respectively, thereby causing the section of the polishing belt 110 in the processing area 116 to move in the bi-directional or reverse linear motion. Polishing chemicals (i.e., slurry) such as those described above are provided between the polishing belt 110 and the wafer surface.

After the section of the polishing belt 110 is used to polish one or more wafers in the processing area 116, a new section of the polishing belt 110 is fed to the processing area 116 in the manner described above. In this manner, after one section of the polishing belt 110 is worn out, damaged, etc., the new section can be used. Consequently, using the present invention, all or most sections of the polishing belt 110 in the supply spool 111 will be used. It is noted that the feeding of a new section of the polishing belt 119 to the processing area 116 can occur in between times that polishing of the wafers is occurring, or the polishing belt 110 can gradually be advanced, such that the new section of the polishing is a new portion, along with a portions that have been previously used, with that portion of the polishing belt that is within the polishing area and closest to the receiving spool 115 having been used the most, and that portion of the polishing belt that is within the polishing area and closest to the supply spool 111 having been used the least.

Although the second preferred embodiment describes an apparatus and driving mechanism having four idle rollers, two rockers arm rollers, two rocker arms, etc., it is understood that any suitable number of idle rollers, rocker arm rollers, rocker arms, etc., can be used to provide the bi-directional linear or reciprocating motion and is intended to be within the spirit and scope of the present invention. In addition, other similar components/devices may be substituted for the ones described above.

In addition, the layout or geometry of the polishing pad/belt with respect to the wafer as illustrated in the first and second embodiments can be changed from those illustrated herein to other positions. For example, one can position the polishing pad/belt above the wafer, position the polishing pad/belt vertically with respect to the wafer, etc.

Figure 7:
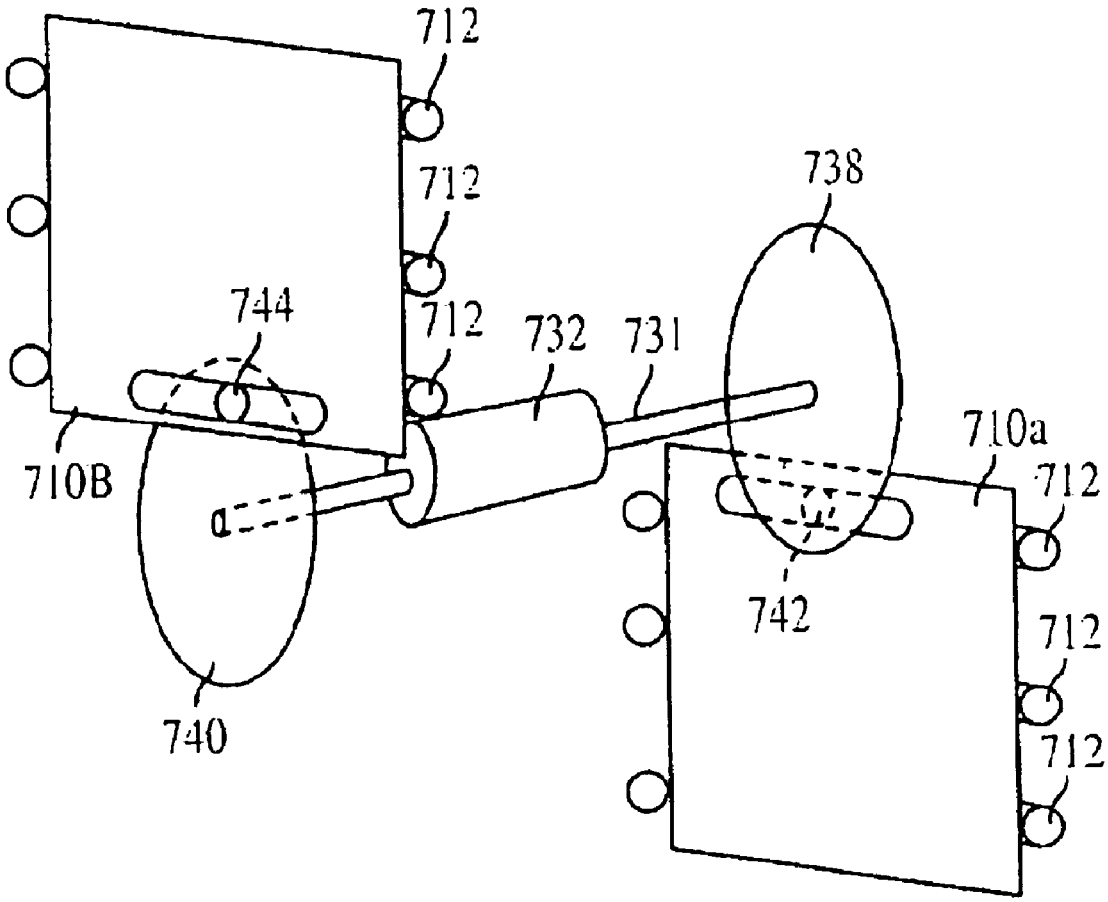
FIG. 7 illustrates a simplified illustration of a drive mechanism for providing a fresh portion of the polishing pad according to the present invention.

FIG. 7 provides a simplified illustration of a drive mechanism for providing a fresh portion of the polishing pad according to the present invention, which provides for a translation of rotational motion to linear up and down motion. As is apparent, rotation of an axle, for example illustrated as axle 731 associated with motor 732 will result in rotation of two drive mounts 738 and 740. To each of these drive mounts is attached some motion translation mechanism 742 and 744, respectively, which are 180 degrees out of phase as attached to the drive mounts 738 and 740, respectively, and also which are attached to different end portions 710*a* and 710*b* of the polishing belt 710, which polishing belt is preferably supported in position, and in particular an appropriate position within a polishing area (not shown), by a support mechanism, shown for example as rollers 712, from a backside of the polishing belt. Rotation of the drive mounts 738 and 740 results in the complementary reciprocating linear motion, such that when drive mount 738 is moving in an upward linear direction, drive mount 740 is moving in a downward linear direction. Thus, with the polishing belt 710 properly positioned between a supply spool and a receive spool (not shown), this movement of the drive mounts 738 and 740 will result in the bi-directional linear movement according to the present invention. Since the support mechanism supports the polishing belt from the backside, and the polishing side, or front side, does not contact the support mechanism, sources of friction other than the wafer that is being polished are minimized from the polishing side of the pad. Thus, polishing side of the pad is not degraded by the support mechanism.

Figure 8A:
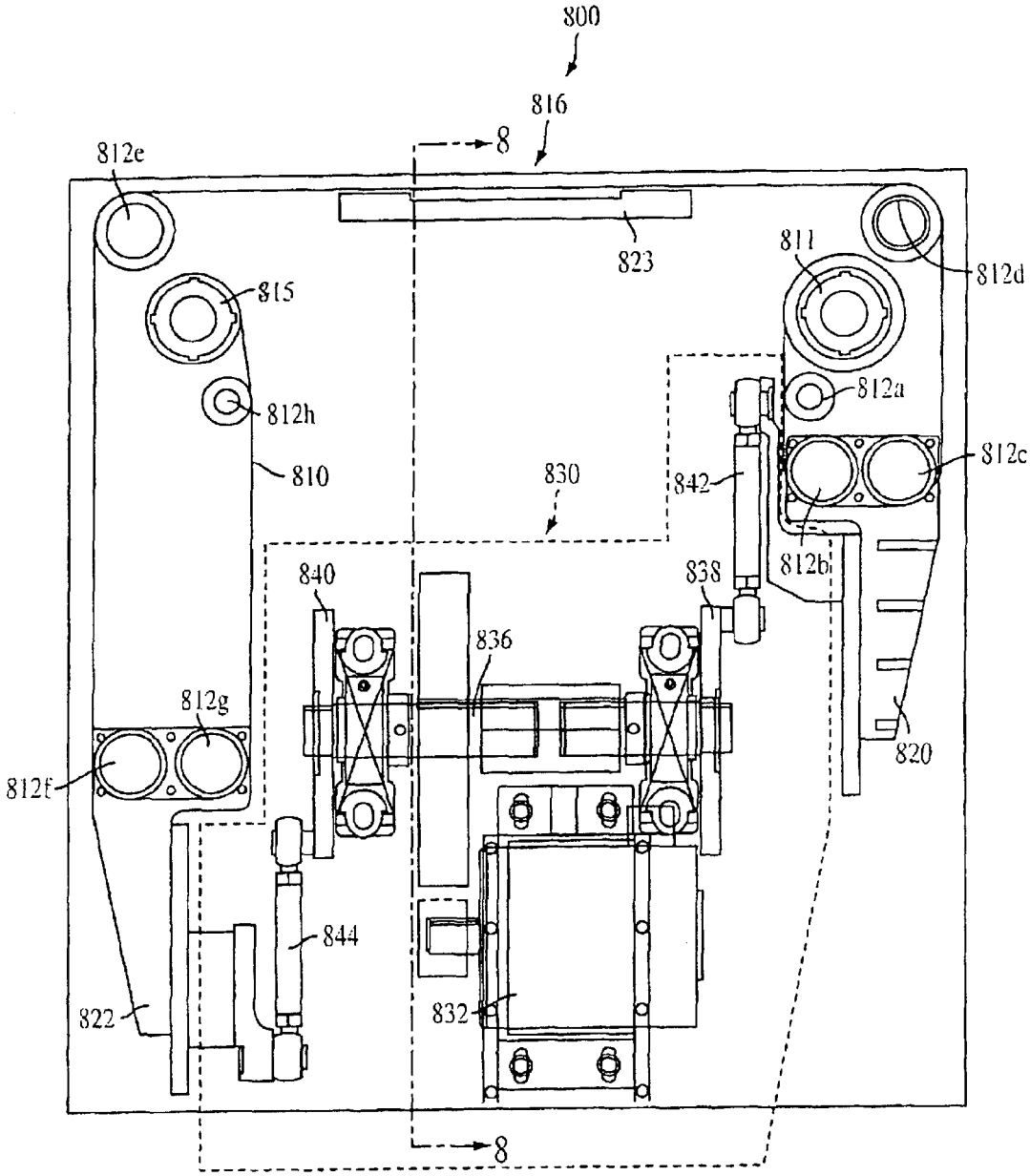
FIGS. 8A and 8B illustrate side and cross-sectional views of a polishing apparatus that includes a drive mechanism for providing a fresh portion of the polishing pad according to the present invention.
Figure 8B:
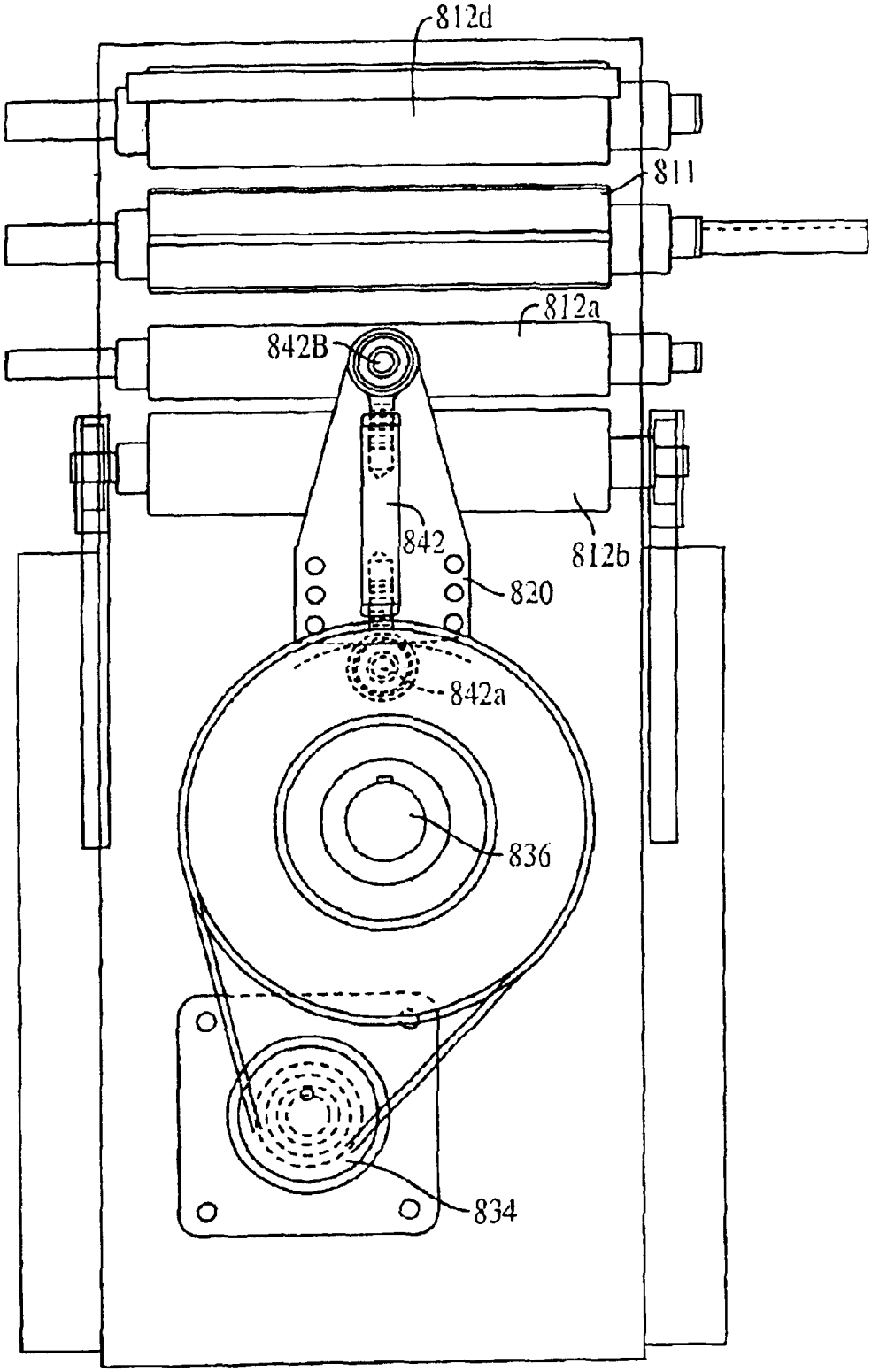

FIGS. 8A and 8B illustrate side and cross sectional views, respectively, of a specific implementation of the drive mechanism described above with respect to FIG. 7 in accordance with the present invention.

The polishing apparatus 800 includes a driving mechanism having a bi-directional linear, or reverse linear, polishing belt 810 for polishing a wafer (not shown) that is supported by the wafer housing (not shown). A processing area 816 has a section of the polishing belt 810 that is supported by a platen 823, which platen 823 is capable of providing "gimbaling" action for leveling/suspending the section of the polishing belt 810 above it. In addition, an air or magnetic bearing may be positioned underneath the processing area 816 to control the pressure between the section of the polishing belt 810 and the wafer surface during the polishing process.

Besides the processing area 816, the polishing apparatus 800 includes in its top portion a supply spool 811, a receiving spool 815, and a polishing belt support mechanism 812, shown as rollers 812*a,* 812*b,* 812*c,* 812*d,* 812*e,* 812*f,* 812*g,* 812*h.* Rollers 812*a,* 812*d,* 812*e* in position, whereas roller pairs 812*b* and 812*c,* as well as 812*f* and 812*g,* are attached to respective drive supports 820 and 822, which are each moved in a complementary reciprocating linear motion that is obtained using a driving mechanism 830. The drive mechanism includes a motor 832, which, via a belt 834 drives axle 836, which in turn will rotate each of the two drive mounts 838 and 840, which in turn provide movement to the elbows 842 and 844, respectively. Each end of the elbows 842 and 844 can rotate about the respective pivot points such as pivot points 842*a* and 842*b* illustrated in FIG. 8B.

With the polishing belt 810 fed between the supply spool 811 and the receiving spool 815, it is apparent that a frontside of the polishing belt 810 will only contact a surface of the wafer or workpiece being polished, while the backside of the polishing belt will be in contact with various surfaces to ensure alignment, including the various rollers 812 described above.

As is apparent, rotation of the axle associated with motor 832 will cause rotation of the belt 834 and the corresponding axle 836, and rotation of the two drive mounts 838 and 840. To each of these drive mounts is attached one of the elbows 842 and 844, which attachments are preferably 180 degrees out of phase. Rotation of the drive mounts 838 and 840 results in the complementary reciprocating linear motion, such that when drive support 820 is moving in an upward linear direction, drive support 822 is moving in a downward linear direction. Thus, with the polishing belt 810 properly positioned between the supply spool 811 and the receive spool 815 and attached, via roller pairs 812*b,* 812*c* and 812*f,* 812*g* to the drive supports 820 and 822, respectively, this movement of the drive supports 820 and 822 will result in the bi-directional linear movement according to the present invention.

Advancing the polishing belt 810, whether that advancement takes place in incremental step portion movement or in larger step portion movement, whether that movement is while the polishing belt 810 is polishing a wafer or between times that polishing belt 810 is polishing a wafer, will allow for a new portion of the polishing belt 810 to come off of the supply spool 811 and a previously used portion to be taken up by the receiving spool 815. The mechanism used to implement this movement is preferably the same clutch mechanism as described above with respect to FIG. 5.

While this embodiment is described using a different drive mechanism than the drive mechanism illustrated in FIG. 5, it should be understood that either of these or other drive mechanisms can be used in accordance with the invention.

It is understood that the second embodiments of the present invention with receiving and supply spools can use various numbers of rollers, various types of drive mechanisms, and the like, which cooperate to provide the bi-directional linear or reciprocating motion and is intended to be within the spirit and scope of the present invention. In addition, other similar components/devices may be substituted for the ones described above.

In addition, the layout or geometry of the polishing pad/belt with respect to the wafer as illustrated in the first and second embodiments can be changed from those illustrated herein to other positions. For example, one can position the polishing pad/belt above the wafer, position the polishing pad/belt vertically with respect to the wafer, etc.

Figure 9:
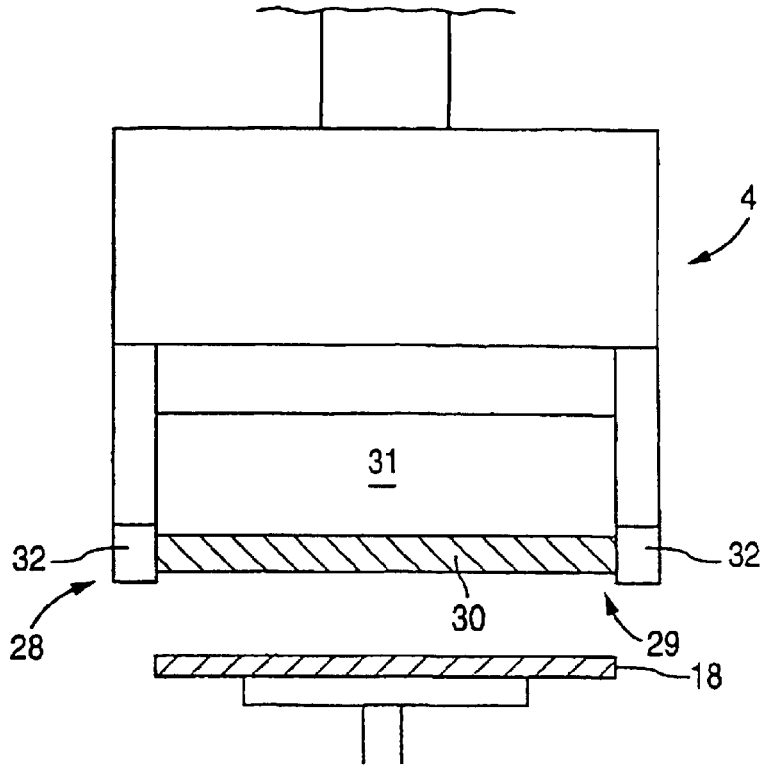
FIG. 9 illustrates a side view of a wafer housing adapted to load and unload a wafer onto a wafer housing in accordance with the preferred embodiment of the present invention.

Next, with reference to FIG. 9, a wafer housing 4 in accordance with the preferred embodiment of the present invention will now be described. Wafer housing 4 includes a nonconductive, preferably circular, head assembly 28 with a cavity 29 that is preferably a few millimeters deep at its center and having a resting pad 30 thereof. The wafer 18 is loaded into the cavity 29, backside first, against the resting pad 30. A conventional type of securing mechanism 31 (i.e. vacuum) is used to ensure that the wafer 18 is securely positioned with respect to the wafer head assembly 28 while the wafer 18 is being polished. The resting pad 30 may also be of a type that secures the wafer 18 by suctioning the backside of wafer 18 when the resting pad 30 is wet.

As described above, the reverse linear polisher 3 may polish the wafer 18 during various stages of the wafer fabrication process. Accordingly, a method for loading the wafer 18 into the cavity 29 so that an additional loading mechanism is not needed will be described with reference to FIG. 10. First, the wafer housing 4 is aligned to load the wafer 18 into the cavity 29. The head assembly 28 includes a pin housing 32 adapted to move up and down with respect to the cavity 29 using a motor or pneumatic control (not shown). During loading of the wafer 18, the pin housing 32 extends down from an original position, which is illustrated by the dashed lines, below the surface 17 of the wafer 18. At least three pins 34 are then automatically caused to protrude out of the pin housing 32 using a conventional retraction device under motor control so that the wafer 18 can be picked up and loaded into the cavity 29 of the head assembly 28. With the pins 34 protruding out, the pin housing 32 automatically retracts back to its original position, and thus the wafer 18 is loaded into cavity 29. When the head assembly 28 and the resting pad 30 secures the position of the wafer 18, as described above, the pins 34 automatically retract back into the pin housing 32 and the pin housing 32 retracts back to its original position so that the wafer 18 may be polished, as illustrated in FIG. 11.

Referring back to FIGS. 1 and 2, after the wafer 18 is securely loaded onto the wafer housing 4, the wafer housing 4 is automatically lowered until the wafer surface 17 is in contact with the polishing pad 6. The polishing pad 6 polishes the wafer surface 17 in accordance with the method described herein; the wafer 18 is then ready to be unloaded from the wafer housing 4.

Figure 10:
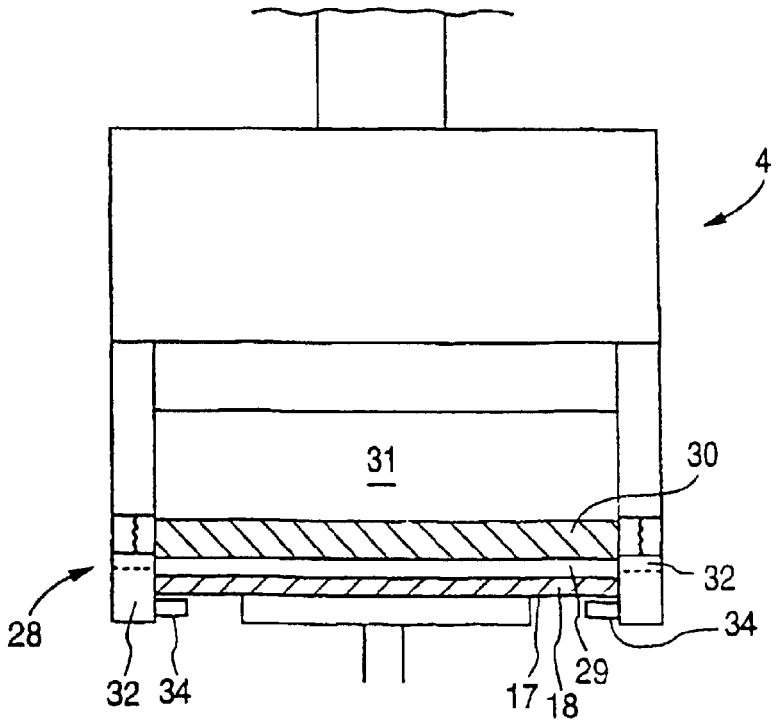
FIG. 10 illustrates a side view of a wafer housing having protruding pins adapted to load/unload a wafer onto a wafer housing in accordance with the preferred embodiment of the present invention.
Figure 11:
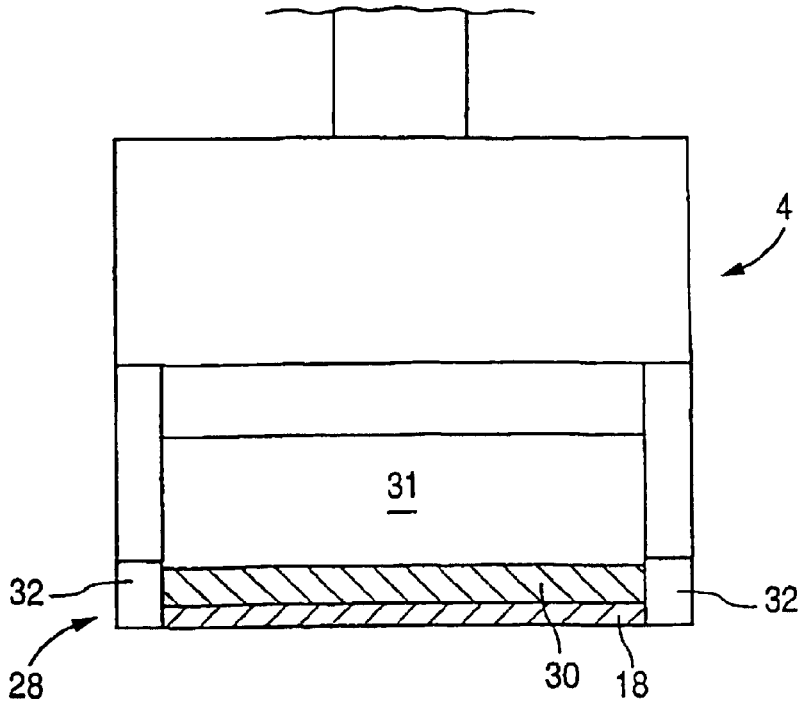
FIG. 11 illustrates a side view of a wafer loaded onto a wafer housing in accordance with the preferred embodiment of the present invention.

With reference to FIG. 10, the wafer 18 is unloaded from the wafer housing 4 using essentially a reverse order of the loading steps. After polishing the wafer 18, the wafer housing 4 is raised from the polishing pad 6, and the pin housing 32 extends down from its original position, which is illustrated by the dashed lines, below the surface 17 of the wafer 18. The pins 34 are then automatically caused to protrude out so that the wafer 18 may be supported when unloaded from the cavity 29. With the pins 34 protruding, the vacuum is reversed with opposite air flow, thus dropping the wafer 18 away from head assembly 28 and onto the pins 34 (i.e., wafer 18 is positioned from the resting pad 30 onto the pins 34). From this position, the wafer can then be transported to the next fabrication processing station.

Figure 12:
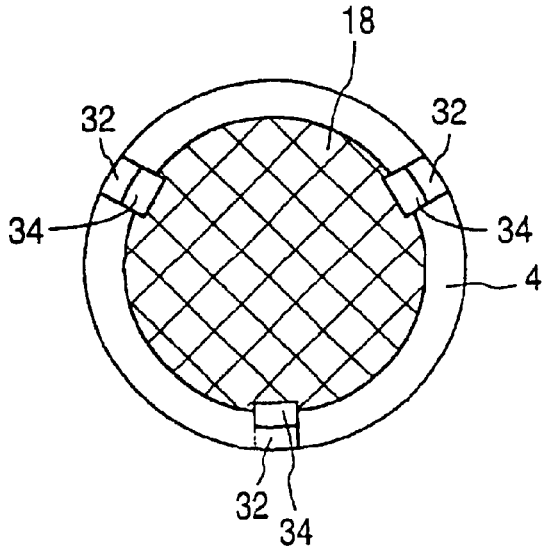
FIG. 12 illustrates a bottom view of a wafer being loaded and unloaded onto a wafer housing by three pins in accordance with the preferred embodiment of the present invention.

FIG. 12 illustrates a bottom view of the wafer 18 surface being loaded and unloaded into the cavity 29 by the pins 34. Although FIG. 12 illustrates three protruding pins 34, it should be understood that more than three pins, or an alternative support mechanism, may be used in accordance with the present invention.

Referring again to FIGS. 1–2, the support plate 10 for supporting the polishing pad 6 will now be described. The polishing pad 6 is held against the wafer surface 17 with the support of the support plate 10, which may be coated with a magnetic film. The backside of the support material to which the polishing pad 6 is attached may also be coated with a magnetic film, thus causing the polishing pad 6 to levitate off the support plate 10 while it moves at a desired speed. It should be understood that other conventional methods could be used to levitate the polishing pad 6 off the support plate 10 while it polishes wafer surface 17, such as air, lubricant, and/or other suitable liquids.

It is to be understood that in the foregoing discussion and appended claims, the terms "wafer surface" and "surface of the wafer" include, but are not limited to, the surface of the wafer prior to processing and the surface of any layer formed on the wafer, including conductors, oxidized metals, oxides, spin-on glass, ceramics, etc.

Although various preferred embodiments of the present invention have been disclosed for illustrative purposes, those skilled in the art will appreciate that various modifications, additions and/or substitutions are possible without departing from the scope and spirit of the present invention as disclosed in the claims.

We claim:

1. A method of processing a semiconductor wafer comprising:

positioning the wafer below a wafer housing;

supporting the wafer around, its periphery; and loading the wafer into a wafer housing cavity.

2. The method of claim 1, further comprising extending a support structure proximate to the wafer periphery.

3. The method of claim 1, further comprising retracting a support structure from proximate to the wafer periphery.

4. The method of claim 2, further comprising retracting the support structure from proximate to the wafer periphery.

5. The method of claim 2, further comprising housing the support structure in a movable support structure housing.

6. The method of claim 5, further comprising moving the support structure housing in an upward and downward direction.

7. The method of claim 1, further comprising treating the wafer.

8. The method of claim 1, further comprising:

releasing the wafer from the wafer housing cavity;

supporting the wafer around its periphery; and unloading the wafer from the wafer housing.

9. A method of processing a semiconductor wafer comprising:

positioning the wafer in a cavity of a wafer housing;

positioning a retractable support structure below the surface of the wafer;

extending the support structure to support the wafer;

moving the support structure so that the wafer is positioned near the surface of the wafer housing; and clearing the support structure from the surface of the wafer.

10. The method of claim 9, further comprising securing the wafer against the surface of the wafer housing.

11. The method of claim 9, further comprising housing the support structure in a movable support structure housing.

12. The method of claim 11, further comprising moving the support structure housing in an upward and downward direction.

13. The method of claim 9, further comprising aligning the wafer housing with the wafer.

14. The method of claim 9, further comprising treating the wafer.

15. The method of claim 9, further comprising:

positioning the support structure below the surface of the wafer;

extending the support structure to support the wafer; and moving the support structure so that the wafer is moved away from the surface of the wafer housing.

16. A semiconductor wafer processing device comprising:

a wafer housing; and a support structure attached to the wafer housing configured to load a wafer into a wafer housing cavity.

17. The semiconductor wafer processing device of claim 16, wherein the support structure comprises retractable members.

18. The semiconductor wafer processing device of claim 17, wherein the support structure comprises at least three retractable members.

19. The semiconductor wafer processing device of claim 17, wherein the retractable members are retractable pins.

20. The semiconductor wafer processing device of claim 16, wherein the support structure is further configured to unload the wafer from the wafer housing cavity.

21. The semiconductor wafer processing device of claim 16, further comprising a movable support structure housing configured to house the support structure and to move in an upward and downward direction to load the wafer into the wafer housing cavity.

22. A semiconductor wafer processing device comprising a head assembly having a cavity adapted to support a wafer and a movable pin housing that includes pins adapted to protrude in and out of the pin housing.

23. The semiconductor wafer processing device of claim 22,further comprising a motor configured to move the pin housing in an upward and downward direction.

24. The semiconductor wafer processing device of claim 22, further comprising a vacuum configured to secure the wafer in the cavity.

* * * * *